US005997000A

United States Patent [19]

Nakano et al.

[11] Patent Number: 5,997,000

[45] **Date of Patent: *Dec. 7, 1999**

[54] COMBINED DICE AND CARD GAME

[76] Inventors: Yoshio Nakano, 12021 Pomering Rd., Downey, Calif. 90242; Don Zewin, 2900 Channel Rock Dr., Las Vegas, Nev. 89117

[ * ] Notice: Under 35 U.S.C. 154(b), the term of this patent shall be extended for 95 days.

[21] Appl. No.: 08/517,909

[22] Filed: Aug. 22, 1995

[51] Int. Cl.[6] ..... A63F 3/00

[52] U.S. Cl. ..... 273/274; 273/292; 273/146

[58] Field of Search ..... 273/146, 292, 273/274, 85 CP, 85 G

[56] References Cited

U.S. PATENT DOCUMENTS 2,560,187 7/1951 Post .
3,614,105 10/1971 Dandini .
3,913,919 10/1975 Carpenter .
4,312,508 1/1982 Wood .
5,308,081 5/1994 Bartle .

*Primary Examiner*—William M. Pierce

[57] ABSTRACT

A combined dice and card game utilizes three conventional six-sided dice and a twenty-four card deck formed by removing all cards other than ace, two, three, four, five, and six of a conventional four-suit fifty-two playing card deck. In a preferred embodiment, one of a plurality of players is selected as the banker and posts a fixed sum of money or chips as a bank. Remaining players place bets against the bank. Each player and the banker then receive three cards dealt from the ace through six stripped playing card deck, and subsequently discard one card, leaving each player and the banker with two cards, ranging from ace through six. The banker, and subsequently the players, then roll the dice and attempt to roll an automatically winning dice combination or to establish a winning point, while attempting to avoid rolling an automatically losing dice combination. The banker and the players may, upon obtaining certain predetermined card and dice combinations, utilize their cards to improve or increase a rolled dice point.

20 Claims, 2 Drawing Sheets

COMBINED DICE AND CARD GAME

BACKGROUND OF THE INVENTION

1. Field Of The Invention

The present invention relates to games, and more particularly pertains to an improved combination card and dice game especially adapted for implementation as a player-banked gambling game.

2. Description Of The Prior Art

Scarne's New Complete Guide To Gambling, First Fireside Edition, Simon and Schuster, Inc., New York, N.Y. 1986, p. 511–513, incorporated by reference herein, discloses a game known as FOUR-FIVE-SIX or THE THREE-DICE GAME. In that prior art game, one of a plurality of players is initially designated as the banker and each remaining player places wagers against the banker.

The banker and players roll three conventional six-sided dice in an attempt to roll an automatic "natural", or winning dice combination, or to establish the highest "point". Automatically winning dice combinations include: (1) the combination four-five-six, (2) any pair and a six, or (3) three of a kind. Automatically losing combinations include: (1) the combination one-two-three, or (2) any pair and a one. When any pair is thrown and the third die is a two, three, four or five, the number on the third die becomes the shooter's "point". If a player or the banker establishes a point, and an opponent fails to roll an automatically winning or automatically losing dice combination, and also establishes a point, the player having the higher point wins. The game does not involve any cards.

SUMMARY OF THE INVENTION

The present invention contemplates an improvement of the previously described FOUR-FIVE-SIX or THE THREE-DICE GAME, by allowing the banker and players to improve a rolled point, upon achieving certain predetermined card and dice combinations.

A combined dice and card game utilizes three conventional six-sided dice and a twenty-four card deck formed by removing all cards other than ace, two, three, four, five, and six of a conventional four-suit fifty-two playing card deck. In a preferred embodiment, one of a plurality of players is selected as the banker and posts a fixed sum of money or chips as a bank. Remaining players place bets against the bank. Each player and the banker then receive three cards dealt from the ace through six stripped playing card deck, and subsequently discard one card, leaving each player and the banker with two cards, ranging from ace through six. The banker, and subsequently the players, then roll the dice and attempt to roll an automatically winning dice combination or to establish a winning point, while attempting to avoid rolling an automatically losing dice combination.

In a preferred embodiment of the invention, a shooter may improve his or her rolled point if the shooter has a first card having a value which matches the rolled dice point, and a second card having a value greater than the rolled dice point. For example, if the shooter rolls a dice combination of two-two-four, the shooter would have a four point. If the player was holding a card combination of four-five, then their improved point value would be a five.

DETAILED DESCRIPTION OF THE PREFERRED EMBODIMENT

Figure 1:
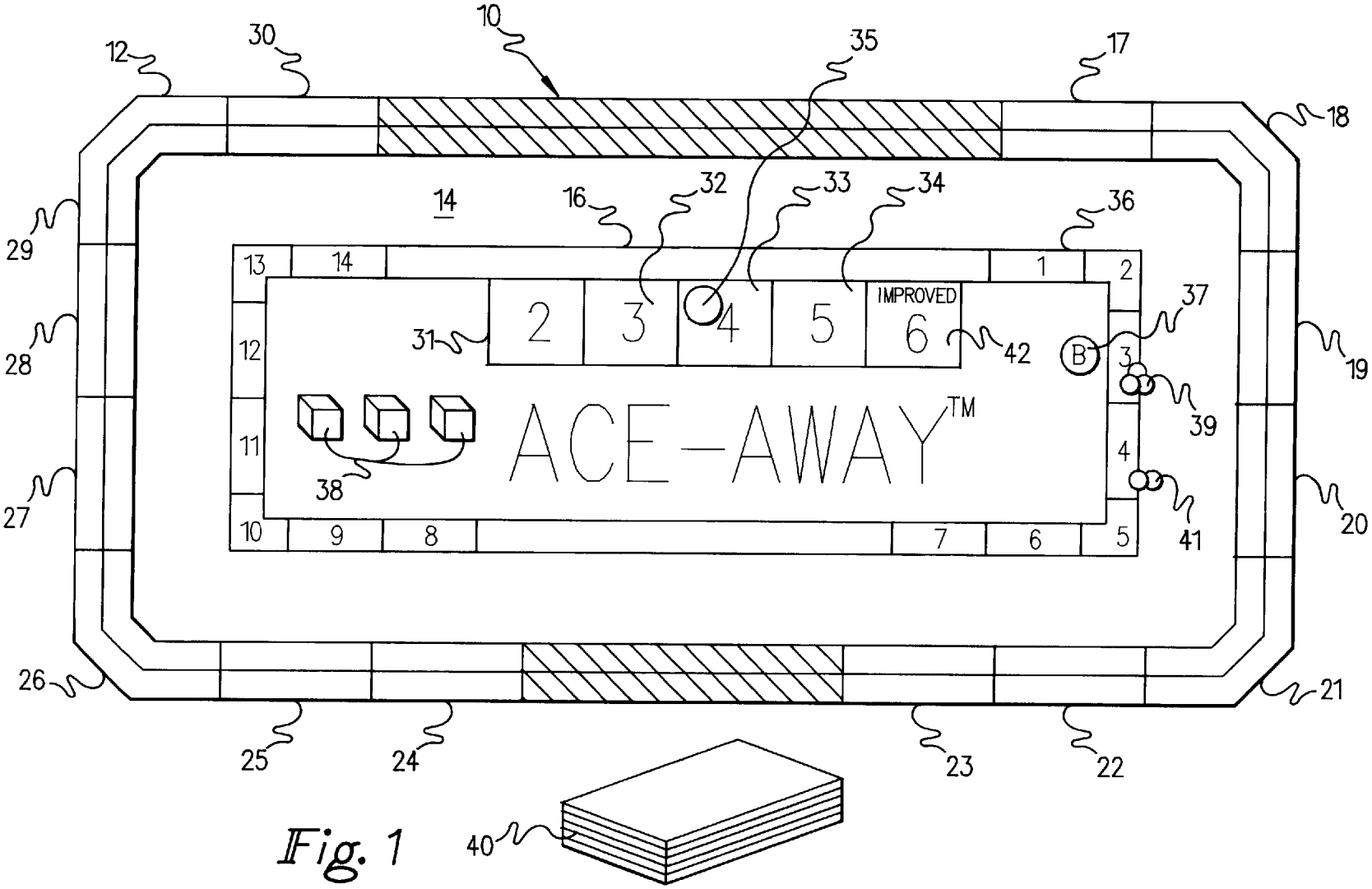
FIG. 1 is a top plan view illustrating a table including a layout adapted for use in the play of the combined card and dice game of the present invention.

With reference now to FIG. 1, the manner of play of the combined card and dice game according to a preferred embodiment of the present invention will now be described. FIG. 1 illustrates a top plan view of a casino gaming table of the same general type conventionally utilized in casinos in the play of a well-known gambling dice game known as "craps". The table 10 includes an upstanding substantially rectangular rail 12 surrounding a flat recessed planar surface 14, preferably covered by a conventional felt layout material imprinted or otherwise provided with a predetermined graphical layout 16 of the illustrated form. The rail 12 generally provides a plurality of player locations 17, 18, 19, 20, 21, 22, 23, 24, 25, 26, 27, 28, 29 and 30 adjacent which players stand during the play of the game. The rail 12 preferably includes suitable grooves dimensioned for holding a particular player's supply of conventional chips or gaming tokens.

The layout 16 preferably includes indicia designating a frame or outer perimeter zone 36 divided into a plurality of segments bearing the indicia 1, 2, 3, 4, 5, 6, 7, 8, 9, 10, 11, 12, 13, and 14, corresponding to the players standing adjacent the respective player locations 17 through 30 spaced about the rail 12.

Figure 2:
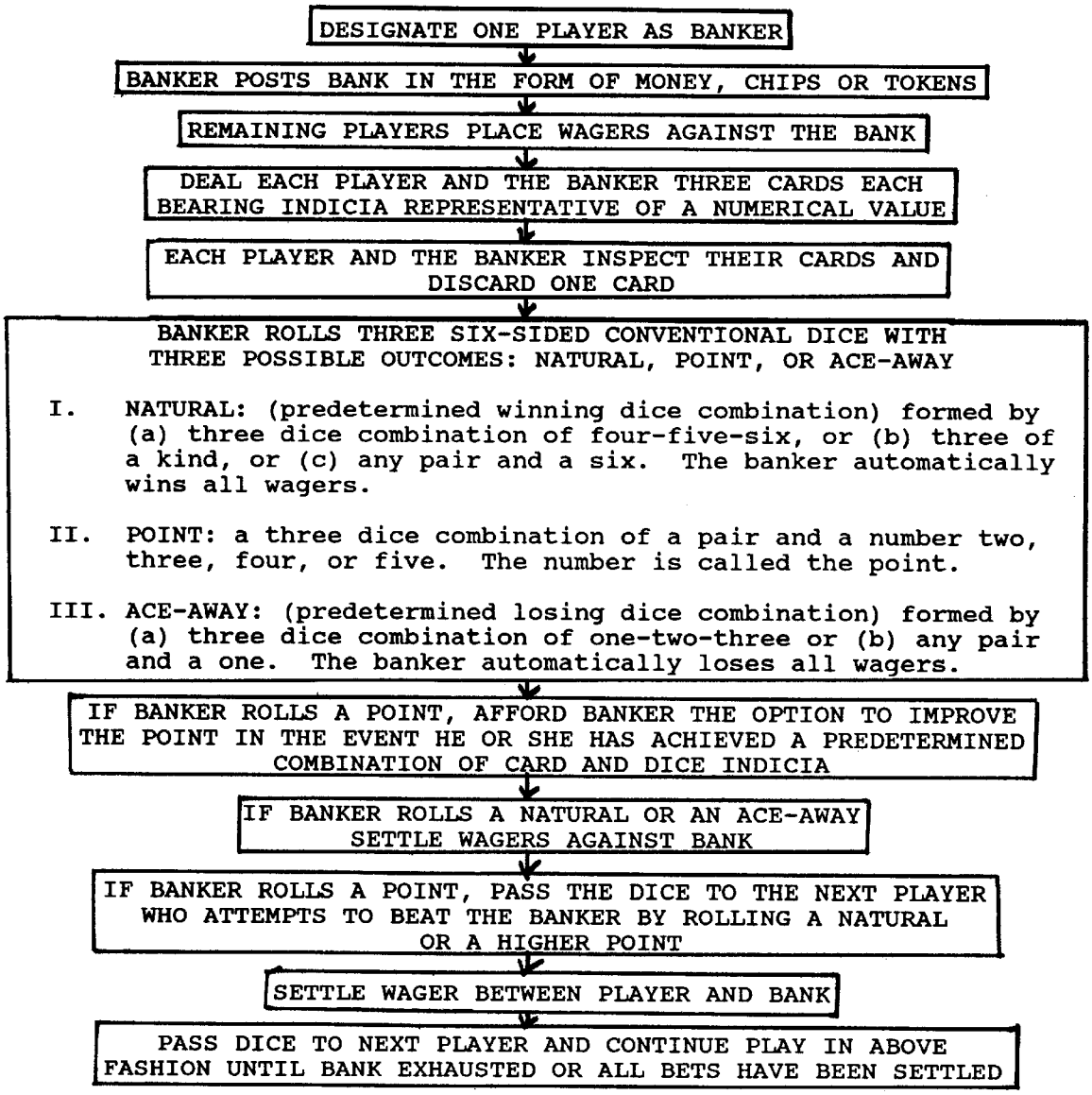
FIG. 2 is a flow chart illustrating the steps of the method of a combined card and dice game according to the present invention.

In the manner of play of the game of the present invention, with references to FIGS. 1 and 2 one of the players, for example the player number 3 disposed adjacent player location 19, is initially selected or designated as the BANKER. A special puck or token 37 is placed adjacent indicia segment 3 on the perimeter layout zone 36 to provide a visual indication confirming the identity of the BANKER. The player number 3, disposed adjacent location 19 on the rail 12, then places or posts a BANK in the form of an amount of money, chips, or other tokens 39 representative of a value on or adjacent to the segment 3 in order to visually inform the remaining players of the amount of the BANK. The remaining players then place bets against the BANK by placing chips or other markers 41 on or adjacent to their particular one of the segments 1 through 14 to signify the amount of their wager.

After each player places his or her bet or wager, each player and the BANKER is then dealt three cards from a card deck 40. The card deck 40 consists of a stripped twenty-four card deck formed by removing all cards except ace, two, three, four, five, and six, in each of the four playing card suits, from a conventional fifty-two playing card deck. After the deal, each player inspects his or her three cards, and then discards one card. This leaves each player and the BANKER with two cards, each card in the range of ace through six.

After completion of wagering, card dealing and discard, the game enters the dice phase. In the dice phase of the game, the BANKER, and, if necessary, each of the remaining players, attempt to roll either a predetermined winning dice combination or "natural" or a highest point, and attempt to avoid rolling a predetermined losing dice combination or "Ace-Away". The terms NATURAL, POINT, and ACE-AWAY are defined as follows:

NATURAL (predetermined winning dice combination): (1) three dice combination of four-five-six, or (2) three of a kind, or (3) any pair and a six.

POINT: A three dice combination of a pair and a number two, three, four, or five. The number is called the "point". For example, the dice combination of two-two-four would be a four-point.

ACE-AWAY (predetermined losing dice combination): (1) three dice combination of one-two-three, or (2) any pair and a one.

The player designated as the BANKER makes the initial roll of the three conventional six-sided dice 38. The BANKER wins automatically if he rolls a NATURAL. Starting at the BANKER'S designated segment on the layout perimeter 36, the BANKER wins all bets to his or her left and continuing in a clockwise direction, to the extent the bets or wagers are covered by the amount posted by the BANKER as his BANK. For example, if the player at location 19 initially posted a BANK in the amount of $500.00, the BANKER can only win wagers upon rolling a NATURAL up to a total of $500.00.

If the BANKER rolls an ACE-AWAY, the BANKER immediately loses. Starting at the BANKER'S left, all bets are paid out as posted on the perimeter zone 36 of the layout 16 in a clockwise direction until the BANK is depleted. Any player winning the last portion of the BANK is said to have "tapped the bank" and obtains the immediate option of either (1) becoming the BANKER and posting a new BANK, or (2) passing the BANK to the player on their immediate left.

The BANKER continues to roll the three dice 38 until the BANKER either rolls a NATURAL, rolls an ACE-AWAY, or establishes a POINT. Upon rolling a POINT (a three dice combination of a pair and a number two, three, four, or five where the number is called the POINT) the BANKER can "improve" his or her POINT by using their cards, in the event they have obtained a predetermined card and dice combination. An "IMPROVED POINT" is one that has been enhanced with a player's two cards. In order to improve their point, any player or the BANKER must have a first card with a value matching the rolled dice point (which may be a two, three, four, or five) and a second card having a value higher than the rolled dice point (which may be a three, four, five, or six). A rolled dice point cannot be improved to three of a kind or to the combination four-five-six.

An improved POINT of six can only be tied by another player obtaining an IMPROVED POINT of six. An IMPROVED POINT of six can only be defeated by three of a kind, a combination of four-five-six, or a rolled (non-improved) POINT of six (which is a NATURAL).

After establishing a POINT or an IMPROVED POINT, the BANKER then passes the three dice 38 to the next adjacent player on the left. For example, assume that the BANKER standing at location 19 had completed the rolling of the dice 38 to establish a rolled or IMPROVED POINT of a four. The BANKER provides a visual indication and designation of the BANKER'S POINT by placing a marker or puck 35 on the corresponding block or zone 33. Note that additional blocks 31, 32, 34, and 42 on the layout 16 designate, respectively, points two, three, five, and IMPROVED six. Thus, in FIG. 1, the marker 35 has been placed on the block 33 to indicate that the BANKER has established a four POINT. The BANKER then passes the dice 38 to the player at location 20, who then rolls the dice in an effort to either beat the BANKER'S POINT, or to roll a NATURAL. If the player rolls a NATURAL or a POINT greater than the BANKER'S (including an IMPROVED POINT), the player beats the BANKER and wins their wager. If the player rolls an ACE-AWAY or a point less than the BANKER'S POINT, the player loses and the BANKER wins the wager, to the extent that the BANK posted by the BANKER covers the wager. If the player rolls the same POINT as the BANKER, the bet is a tie or push, and no money is won or lost. If the BANKER'S POINT is an improved six, then the only way the player can tie is with an improved six. Neither the BANKER or any player can utilize their cards to prevent an ACE-AWAY.

After the player at location 20 has completed their turn, and settled their particular bet with the BANKER, the dice are then passed again to the left, in a clockwise direction, to the player at location 21. The next player rolls the dice in the manner previously described, and play continues in this fashion until the entire BANK is depleted or until all the bets have been settled.

Any player who wins the last portion of the BANK, or "taps the bank" has the option of either taking possession of the remaining quantity of the BANK, or passing the BANK to the player on their immediate left. If the BANK has not been "tapped", then the player that rolls the first four-five-six dice combination or three of a kind can take the BANK, including the entire amount of chips or money posted by the BANKER. If any player rolling the first four-five-six or three of a kind passes, or declines to take the BANK, then the option goes to the next player rolling either a four-five-six dice combination or a three of a kind. If all such players who roll one of these two combinations pass the BANK, then the original BANKER may retain the BANK. The original BANKER, upon retaining the BANK, may not decrease the BANK, but may increase the amount of the BANK by adding additional chips or money to the remaining sum. In the event that the original BANKER also passes or declines to retain the BANK, the BANK is mandatorily passed to the next player on the left in a clockwise direction.

A single twenty-four card stripped ace through six deck is adequate to allow play by a total number of players (including the BANKER) of eight. The number of players may be increased by combining two or more stripped twenty-four card ace through six decks, in order to allow an adequate number of cards to deal three cards to each player and to the BANKER.

While the preferred embodiment of the invention contemplates banking of the game by the players, the invention may also be practiced in the form of a game banked by the house or casino.

A variety of other modifications of the invention may also be made within the scope of the present invention. For example, the game may be played by dealing only two cards to a player, and eliminating the discard. The game may also be played using greater or lesser numbers of cards or dice. The predetermined combinations of dice and card indicia necessary to obtain an IMPROVED POINT, or to achieve an automatically winning or losing dice combination, may also be varied. Further, instead of a player competing against and attempting to beat a POINT established by a BANKER or house, the game may be employed in connection with a preset POINT which a player must beat. For example, a player might always have to beat a preestablished four POINT.

As may now be understood, the present invention, broadly contemplates the provision of a combined card and dice game in which a player rolls at least one die having faces bearing indicia representative of a numerical value to establish a POINT, and subsequently has an opportunity to improve the POINT upon achieving a predetermined combination of numerical card and dice indicia. While the use of conventional dice bearing numerical indicia and playing cards bearing corresponding numerical indicia ace through six is preferred, other forms of indicia may also be employed. For example, cards and dice bearing specialized non-numerical indicia or symbols such as cherries, plums, apples, clubs, hearts, spades, etc. may be employed, without altering the salient objective of providing a correlation between indicia on the dice and the cards in order to enable formation of predetermined combinations of card and dice indicia for the purpose of establishing an IMPROVED POINT.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

We claim:

1. In a method of playing a combined card and dice game, the improvement comprising the steps of:

(a) dealing to at least one player at least two cards bearing indicia;

(b) a player rolling at least one die having faces bearing indicia to establish a rolled point; and (c) permitting a player to improve a rolled point upon achieving a predetermined combination of said indicia of said cards and said at least one die.

2. The method of claim 1 wherein faces of said at least one die bear indicia representative of a numerical value.

3. The method of claim 2 wherein said at least one die has six faces bearing indicia representative of the numbers one through six.

4. The method of claim 1 wherein each of said cards bear indicia representative of a numerical value.

5. The method of claim 4 wherein each of said cards bear indicia representative of a numerical value in the range of ace through six.

6. The method of claim 1 comprising, in step (a), dealing at least three cards to at least one player.

7. The method of claim 6 further comprising the step of a player discarding at least one card.

8. The method of claim 1 wherein in step (b) a player rolls at least two dice.

9. The method of claim 8 further comprising the step of a player winning upon achieving a predetermined combination of said indicia of said at least two dice.

10. The method of claim 8 further comprising the step of a player losing upon achieving a predetermined combination of said indicia of said at least two dice.

11. In a method of playing a combined dice and card game, the improvement comprising the steps of:

(a) dealing to at least one player at least two cards each bearing indicia representative of a numerical value;

(b) a player rolling at least two dice, each of said dice having faces bearing indicia representative of numerical values, to establish a rolled point; and (c) permitting a player to improve a rolled point upon achieving a predetermined combination of said indicia of said cards and said indicia of said dice.

12. The method of claim 11 wherein each of said dice has six faces bearing indicia representative of the numbers one through six.

13. The method of claim 11 wherein each of said cards bear indicia representative of a numerical value in the range of ace through six.

14. The method of claim 11 comprising, in step (a), dealing at least three cards to at least one player.

15. The method of claim 14 further comprising the step of a player discarding at least one card.

16. The method of claim 11 further comprising the step of a player winning upon achieving a predetermined combination of said indicia of said at least two dice.

17. The method of claim 11 comprising, in step (b), a player rolling at least three dice.

18. In a method of playing a combined dice and card game, the improvement comprising the steps of:

(a) dealing to at least one player at least three cards each bearing indicia representative of a numerical value;

(b) a player discarding at least one card;

(c) a player rolling at least three dice, each of said dice having faces bearing indicia representative of numerical values, to establish a rolled point; and (d) permitting a player to improve a rolled point upon achieving a predetermined combination of at least two cards and said dice, in which indicia of at least one of said cards corresponds to indicia of at least one of said dice.

19. The method of claim 18 further comprising the step of a player placing a wager.

20. The method of claim 19 further comprising the step of settling said wager dependent on the roll of said dice.

* * * * *